United States Patent [19]

Langenfeld

[11] 3,962,691

[45] June 8, 1976

[54] DEVICE FOR THE TRANSMISSION OVER A DISTANCE OF INDICATIONS IN PARTICULAR OF A METER

[75] Inventor: Michel Langenfeld, Vandoeuvre-les-Nancy, France

[73] Assignee: Pont-A-Mousson S.A., Nancy, France

[22] Filed: Nov. 27, 1974

[21] Appl. No.: 527,784

[30] Foreign Application Priority Data

Nov. 29, 1973 France ..... 73.42592
Nov. 4, 1974 France ..... 74.36617

[52] U.S. Cl. ..... 340/203; 340/188 R; 340/191

[51] Int. Cl.[2] ..... G08C 19/16

[58] Field of Search ..... 340/203, 188 R

[56] References Cited

UNITED STATES PATENTS

| | | | |
|---|---|---|---|
| 2,325,744 | 8/1943 | Cooper | 340/203 |
| 2,832,067 | 4/1958 | Howe | 340/203 |

*Primary Examiner*—Thomas B. Habecker
*Attorney, Agent, or Firm*—Sughrue, Rothwell, Mion, Zinn & Macpeak

[57] ABSTRACT

A meter to be read which has indicator drums and an exterior connector and, on the other hand, a reading apparatus for making a reading of the indications of the drums detachably connected to the connector. A coding unit in the meter comprises for each drum a stepped cam connected to rotate with the corresponding drum. A movable follower is elastically biased against the stepped cam. A smooth cam driven by drive means is capable of maintaining the follower spaced away from the stepped cam outside periods in which the reading apparatus makes said reading. A device detects the movement of the follower.

The smooth cam has, in part, a camming surface whose radius increases regularly between values corresponding to the bearing of the follower on end sectors of the stepped cam. A substantially radially extending surface interconnects the maximum and minimum radius parts of the camming surface. The drive means are adapted to cause the smooth cam to effect a predetermined number of rotational steps in the direction of increasing radii of the camming surface. A counter in the reading apparatus counts the steps effected by the smooth cam when the follower cooperates with said part of the smooth cam.

12 Claims, 19 Drawing Figures

DEVICE FOR THE TRANSMISSION OVER A DISTANCE OF INDICATIONS IN PARTICULAR OF A METER

BACKGROUND OF THE INVENTION

1. Field of the Invention

The present invention relates to a device for transmitting over a distance the angular position of rotary elements and in particular indicator drums of a meter or counter. It concerns more particularly fluid or electrical energy consumption meters the indications of which are given by rotary drums.

2. Description of the Prior Art

The devices for the transmission over a distance of the indications of a meter are adapted to reduce the time for reading the meter and the expense of invoicing the consumed amounts of fluid or electrical energy. Indeed, in the absence of such a device the inspection of the meters results in loss of time for the personnel whose function is to effect these readings, since the counters are usually placed in premises and the personnel whose function is to read the meters must often carry out several operations. Moreover, the invoicing requires several recordings of the reading figures and of the number of the subscriber, which entails serious risks of error.

Devices for the transmission over a distance of the indications of a meter are known. The most perfected of these devices only consume electrical energy at the moment of the measurements. This is particularly the case of devices of the type comprising, connected to an exterior socket — to which may be connected an apparatus for reading and generating current and decoding — on one hand, a coding unit comprising for each rotary element a cam which is recessed in steps and connected to rotate with its rotary element, a follower elastically biased toward the stepped cam, and a smooth cam connected to drive means and adapted to maintain the follower away from the stepped cam outside the reading periods, and, on the other hand, a device for detecting the movement of the follower.

A known device of this type is described in particular in the West German Offenlegungsschrift No. 1,939,533. In this device, at the moment of the measurement, the smooth cam is rotated in the direction of decreasing radii; the follower consequently moves, in constant cooperation with the smooth cam, until it comes into abutment with one of the sectors of the stepped cam. The extent of this movement of the follower is measured by the detecting device which sends pulses transmitted to the counter of the reading apparatus.

This known device has the following drawbacks: first, the continuous movement of the follower between its position in which it bears against the stepped cam is amplified by gearing before it is measured and this gives rise to problems due to play in the transmission at the start and end of the movement. This play adversely affects the precision in the measurement and might lead to a different result which differs to the extent of at least one unit, more or less, with respect to the actual indication of the indicator drum. Moreover, even if the follower constantly cooperates with the smooth cam, it comes in contact with the stepped cam relatively suddenly, and this might result in rebounds and vibrations of the follower which are liable to cause the detecting device to produce parasitic pulses, this detecting device being of necessity very sensitive since one pulse corresponds to a very small movement of the follower. It is easy to imagine the seriousness of such parasitic pulses when it concerns the measurement of, for example, the indication of the meter indicator drum corresponding to the tens of thousands.

SUMMARY OF THE INVENTION

An object of the present invention is to overcome these drawbacks and to provide a device which gives indication of the exact position of each rotary element with no possible error.

According to the invention, there is provided a device of the aforementioned type wherein on at least a part of the smooth cam the radius of the smooth cam increases regularly between values corresponding to the bearing of the follower on the end sectors of the stepped cam, the end radii of the smooth cam being interconnected by a roughly radially extending surface, and said drive means is adapted to cause the smooth cam to effect a predetermined number of rotational steps in the direction of increasing radii, means being provided in the reading apparatus for counting the steps effected when the follower cooperates with said part of the smooth cam.

In one embodiment, the device detecting the movement of the follower comprises a wheel connected to rotate with a gear wheel meshing with a toothed sector provided on the follower, the gear wheel carrying on its periphery magnets having alternating poles, a switch having a flexible blade disposed in confronting relation to said gear wheel being adapted to produce an electrical signal in response to any movement of the follower.

In another embodiment of the detecting device, which in particular economizes space, the detecting device is constituted by the follower, the latter comprising a first nose and a second nose respectively located in the plane of the smooth cam and in the plane of the stepped cam, the second nose being connected to the first nose by elastically yieldable connecting means.

The means for driving the smooth cam may be a ratchet wheel stepped by a pulse-actuated electromagnet. This drive means may also be a motor whose output shaft is provided with means for detecting the rotation of this shaft and producing pulses in accordance with this rotation, this means being adapted to stop the motor when said predetermined number of pulses has been produced.

BRIEF DESCRIPTION OF THE DRAWINGS

Further features and advantages of the invention will be apparent from the ensuing description with reference to the accompanying drawings in which.

Figure 1:
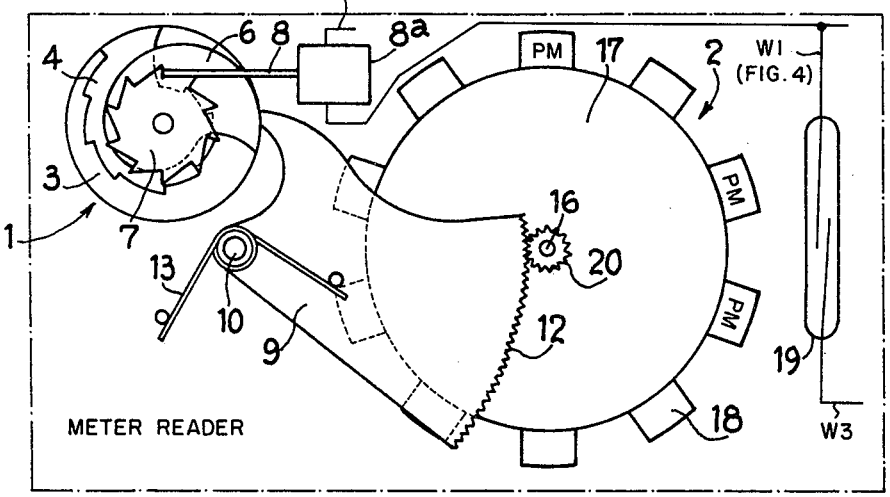
FIG. 1 is a partial diagrammatic side elevational view of a totalizer drum coupled to a device according to the invention.
Figure 6:
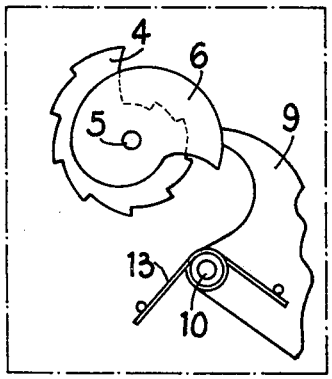
FIGS. 6 to 9 are partial diagrammatic views, to a reduced scale, illustrating the various stages of the reading of the indication of the drum by means of the device shown in FIGS. 1 to 4.

The device shown in FIG. 1 comprises a coding unit 1 and a detecting device 2. The illustrated device is applied to the reading of the indication of a meter or counter drum 3 which is graduated from 0 to 9.

Figure 2:
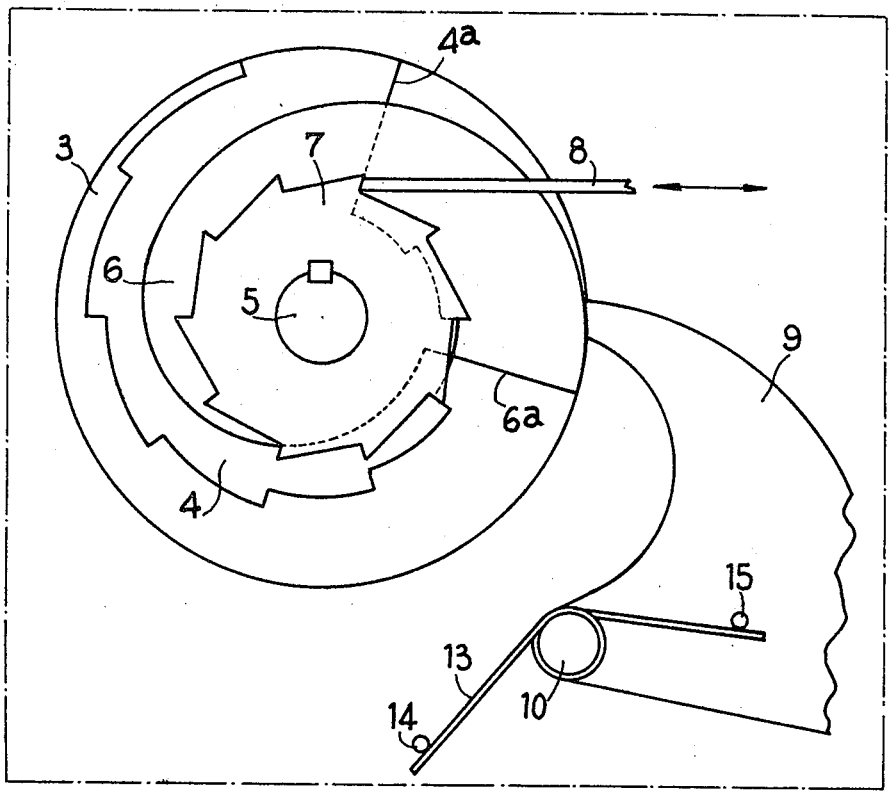
FIGS. 2 and 3 are respectively a side elevational view and a plan view, to an enlarged scale, of a part of this device.
Figure 3:
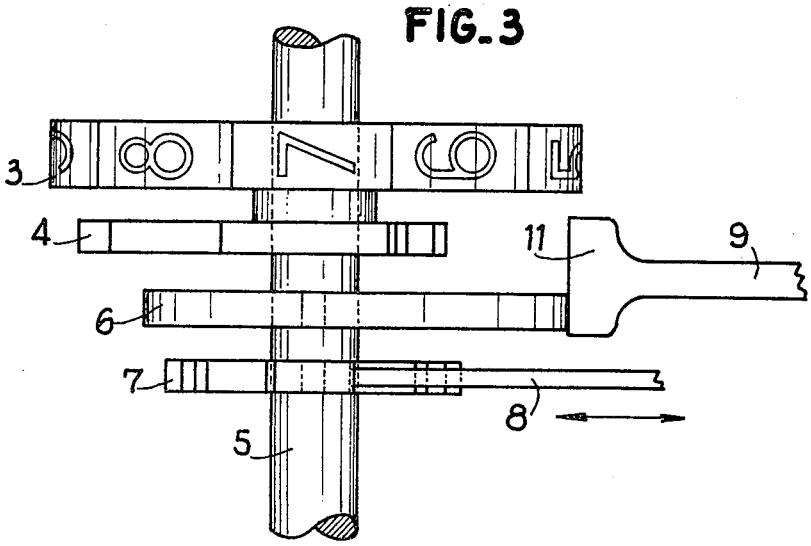

As can be seen better in FIGS. 2 and 3, the drum 3 is connected to rotate with a stepped cam 4 divided into ten sectors of the same angular extent, and evenly stepped, each sector having a constant radius and corresponding to one of the divisions of the drum, the sector of largest radius having half the diameter of the drum 3 and corresponding to the figure 0 of this drum. Each pair of successive sectors are connected by a substantially radially-extending surface $4^a$. The assembly comprising the drum 3 and stepped cam 4 is driven by the mechanism of the meter (not shown) and is mounted to be freely rotatable on a shaft 5 on which are fixed a smooth cam 6 and a ratchet wheel 7. The smooth cam 6 has a radius which varies in a continuous manner on one complete revolution between that of the sector of smallest radius of the stepped cam 4 and that of the largest radius of these sectors, the radii being interconnected by a roughly radially-extending surface $6^a$. The teeth of the ratchet wheel 7 are oriented in a direction opposed to those formed by the sectors of the stepped cam 4 and are ten in number. The angle between two teeth of the wheel 7 therefore corresponds to that of a sector of the stepped cam 4. The ratchet wheel 7 is actuated by a ratchet 8 whose movement is controlled by a pulse-actuated electromagnet $8^a$, one pulse advancing the wheel 7, and therefore the smooth cam 6 is connected to rotate with the wheel, one tenth of a revolution.

The coding unit 1 also comprises a follower 9 pivotally mounted on a pin 10 and having a nose 11 at one end, adjacent the cams, and at its other end a toothed sector 12. The pin 10 is parallel to the shaft 5 and to the nose 11 of the follower 9 which is wide enough to be capable of bearing on that one of the two cams 4 and 6 which has in the region of the nose 11 the peripheral surface which is the most remote from the shaft 5 (FIG. 3). The follower 9 is biased elastically toward the cams 4 and 6 by a spring 13 which is coiled around the pin 10 and has one end disposed under a pin 14, provided on a fixed surface of the housing of the device, and another end bearing under a pin 15 carried laterally by the follower 9.

The detecting device 2 comprises, rotatably mounted on a shaft 16 parallel to the shaft 5 and pin 10, means for amplifying the movements of the follower and comprising a disc 17 which carries on its periphery ten small magnets 18 which present alternately outwardly north poles and south poles evenly spaced apart. The wheel 17 is placed in front of a switch 19 having flexible blades or strips. The switch is in the vicinity of the peripheral surface of the disc 17 and is disposed on the opposite side of the shaft 17 to the reading unit 1. The shaft 16 carries a gear pinion 20 which is connected to rotate with the disc 17 and meshes with the toothed sector 12 of the follower 9. Thus, any pivoting of the sector 12 rotates the disc 17 and this causes to pass in front of the switch 19 magnets having opposite polarities which produce changes in the state of the switch. A change of state of the switch 19 constitutes a closure when starting with an open position of the switch 19 with its blades separated or vice-versa. In particular, any small radial movement of the nose 11 corresponding to the difference of radius between two adjacent parts of the smooth cam 6 produces at least one change of state.

The remainder of the transmission device comprises electrical and electronic means well known per se which, together with their connections, will now be described with reference to FIG. 4.

The electromagnet $8^a$ is connected by two wires W1 and W2 to two terminals of an exterior connector or socket 21 having three terminals; the switch 19 is connected to the wire W1 and, through a wire W3, to the third terminal of the socket 21. The latter is located in the region where the reading of the meter has to be made by means of a portable reading apparatus designated generally by the reference numeral 22 connected by three wires, W1′, W2 and W3′, to a plug 23 having three pins which are adapted to be connected for purposes of the reading in the terminals of the socket 21 corresponding respectively to the three wires W1, W2 and W3.

The reading apparatus 22 comprises, fed by the same *d-c* generator 24, a programmer 25, a detector 26 detecting the change of state of the switch 19, and a pulse counter 27 provided with means 28 for displaying the result.

The wire W1′ is connected to ground or the reference voltage (negative pole) of the generator 24, the positive pole of the latter being connected to a terminal of a switch 29 of the programmer 25. The wire W2′ is connected to the other terminal of the switch 29 and the pulse counter 27 is connected between the wire W2′ and ground. Consequently, when its counting circuit is closed, the counter 27 records any closure of the switch 29.

The change of state detector 26, connected between the ground and the positive terminal of the generator 24, is connected to the pulse counter by a wire W4 for a reason explained hereinafter; it is also connected by a wire W5 to a terminal of a second switch 30 of the programmer 25; the wire W3′ is connected to the other terminal of the switch 30.

The detector 26 includes a flipflop and the switches 29 and 30 are controlled by the same clock 25a in the manner described hereinafter.

The operation of the device will now be described with reference to FIGS. 5–9.

Figure 5:
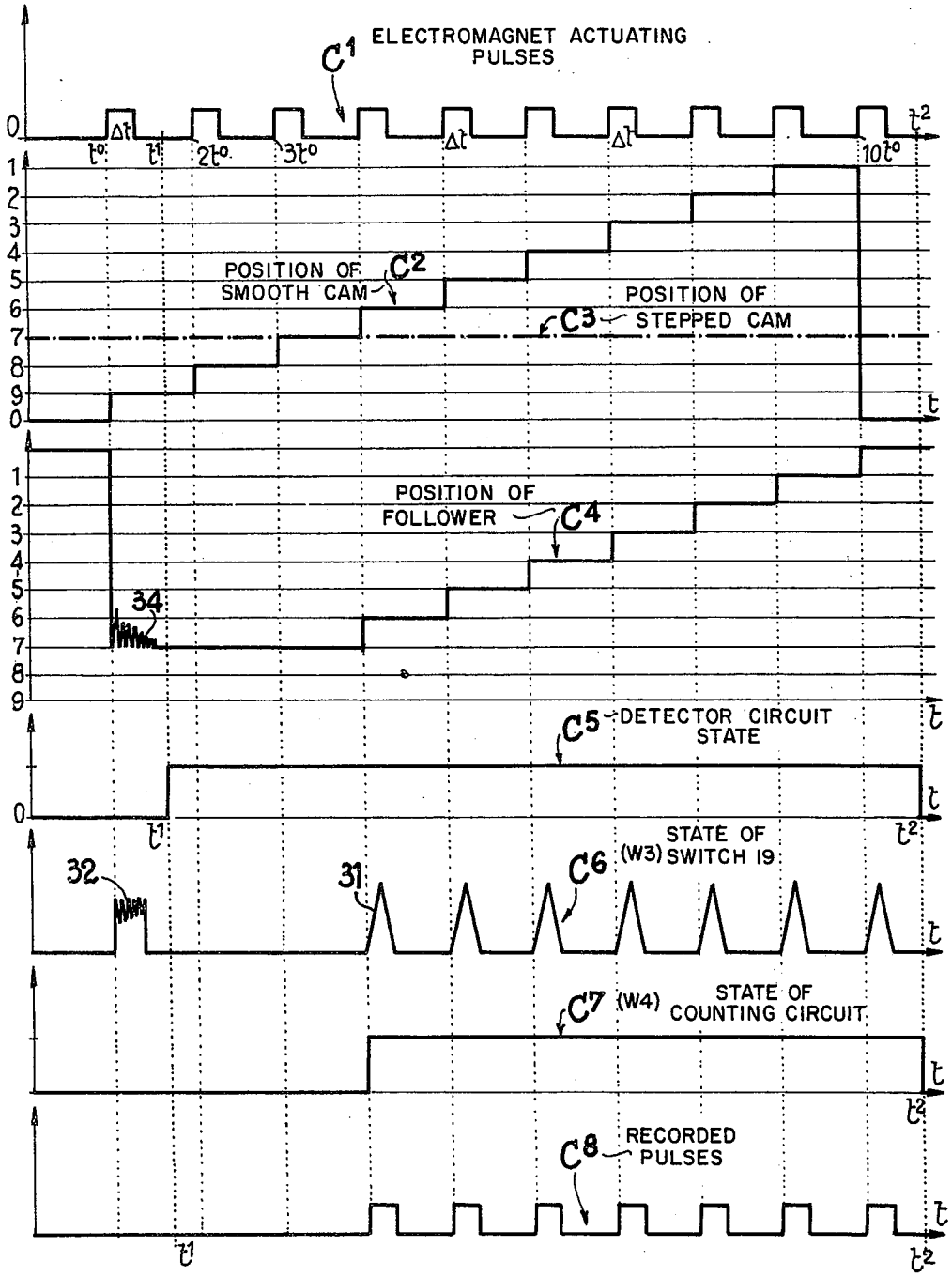
FIG. 5 is a diagram illustrating the operation of this device.

FIG. 5 is a diagram of the simultaneous operation of the various elements of the device with, as common abscissa, the time t measured from the instant 0 of the plugging of the apparatus 22 in the socket 21; moreover, FIG. 5 shows, as ordinates: the electromagnet actuating pulses (curve $C^1$), the position of the smooth cam 6 (curve $C^2$), the position of the stepped cam 4 (curve $C^3$), the position of the follower 9 (curve $C^4$); the state of the circuit of the detector 26 (curve $C^5$); the changes of state of the switch 19 (curve $C^6$); the state of the counting circuit (curve $C^7$); and the recorded pulses (curve $C^8$).

Before the plugging of the reading apparatus in the socket 21, the indicator drum (not shown in FIGS. 6 to 9 for reasons of simplification) indicates a figure from 0 to 9 and the stepped cam 4 associated therewith is in a given corresponding position (FIG. 5, curve $C^3$). Let it be assumed, for the description of the operation of the device, that the indication of the drum is 7. The smooth cam 6 is in such position that its part having the largest radius is in front of the nose of the follower 9, the latter being consequently urged back to the maximum extent in opposition to the force exerted by the spring 13. It will be observed that in this position of rest the follower 9 exerts no action or friction on the totalizer. Operation of the meter is therefore unaffected by the presence of the reading apparatus.

When the person whose function is to read the meter connects his reading apparatus, he starts up a succession of the following operations:

The clock of the programmer closes the switch 29 at instants $t^0$, $2t^0 \ldots . 10t^0$, during a short interval of time $\Delta t$ (curve $C^1$); further, at an instant $t^1$ between $t^0 + \Delta t$ and $2t^0$, it closes the switch 30 until an instant $t^2$ following on the last opening ($10t^0 + \Delta t$) of the switch 29.

Each closure of the switch 29 causes a pulse to be produced by the electromagnet $8^a$ and consequently causes the ratchet 8 to reciprocate and shift the ratchet wheel 7 through one step and the smooth cam 6 associated therewith in the direction for increasing the radius of the latter. However, when the first pulse is effected, the switch 30 is open, which ensures that no change in the state of the switch 19 can be detected before the time $t^1$. After this instant $t^1$, the first change in state 31 of the switch 19 (curve $C^6$) is detected and this causes the detector 26 to produce an order for the start of the counting which is sent to the counter 27 through the wire W4 (curve $C^7$); this counter 27 counts and displays all the pulses following on this order (curve $C^8$).

When the first pulse is produced, the ratchet wheel 7 and the smooth cam 6 advance by one tenth of a revolution.

Figure 7:
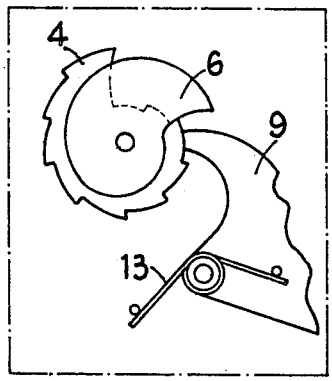

As the nose 11 of the follower 9 is initially on the part of the smooth cam 6 of largest radius, it is no longer supported, after the first movement of the smooth cam, and is biased by the spring 13 against that sector of the stepped cam 4 disposed in front thereof (FIG. 7 and curve $C^4$ of FIG. 5). This sector is at a distance from the shaft 5 which depends on the angular position of the stepped cam 4 and therefore of the totalizer drum. This movement of the follower 9 between its position of rest and the position in which it is caused to bear on this sector is representative of the indication of the drum.

During this movement, the wheel 17 is driven in rotation and a number of magnets 18 pass in front of the switch 19 and produce a corresponding number of changes of state 32 (FIG. 5, curve $C^6$) which are not detected since they are prior to the instant $t^1$ of closure of the switch 30. The interval of time between $t^1$ and $t^0$ is large enough to allow the follower at instant $t^1$ to terminate any rebound 34 (FIG. 5, curve $C^4$) on the stepped cam 4. The electromagnet continues to send pulses to the ratchet 8 with the switch 30 closed and thereby rotates the ratchet wheel 7 step-by-step. As mentioned hereinbefore the latter effects, for each movement of advance of the ratchet 8, one tenth of a revolution (FIG. 5, curve $C^2$). The smooth cam 6 therefore continues its movement of rotation step by step and, until the cam 6 has angularly caught up with the stepped cam (FIG. 8), the nose 11 continues to bear against the stepped cam 4. Up to this stage of operation, the pulses are therefore not counted.

Figure 8:
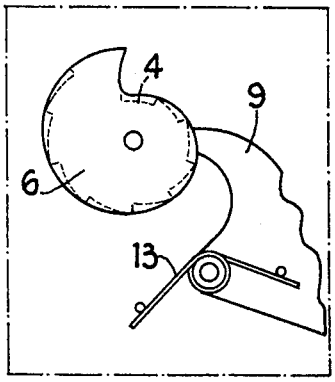
Figure 9:
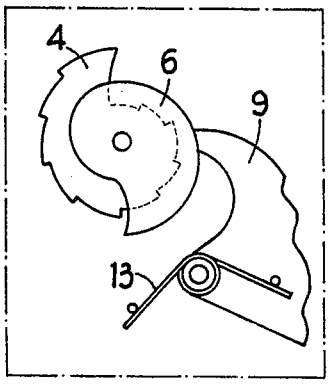

Onward of the position shown in FIG. 8, one pulse of the electromagnet, which turns the smooth cam 6 through another tenth of a revolution, shifts the nose 11 of the follower of the stepped cam a distance equal to the radial distance between two neighbouring sectors of this stepped cam (FIG. 9). This movement of the follower 9 is amplified by the gearing 12-20 and causes, right from the start, a change of state 31 (FIG. 5, curve $C^6$) of the switch 19.

As this change of state 31 occurs at an instant following on $t^1$, when the switch 30 is closed, it is detected by the detector 26 which gives the order to the counter 27 to start the counting of the subsequent pulses of the electromagnet; the number of these pulses recorded corresponds to the number of steps to be passed through by the smooth cam 6 to return to its initial position, and therefore also the number of sectors between the sector on which the follower bore and the sector having the largest radius. At the end of ten pulses, the follower 9 has returned to its starting position shown in FIG. 6 and the switch 30 opens (instant $t^2$, FIG. 5) and determines the end of the reading.

Although the circuit of the switch 19 closes upon the slighest movement of return of the follower 9, the pulse corresponding to this first elementary movement is of sufficient duration to cause the start of the counting and to be itself recorded, the step-by-step movements being practically instantaneous. There has therefore been achieved an exact measurement of the indication of the drum when the reading device has returned to the position shown in FIG. 4.

Figure 10:
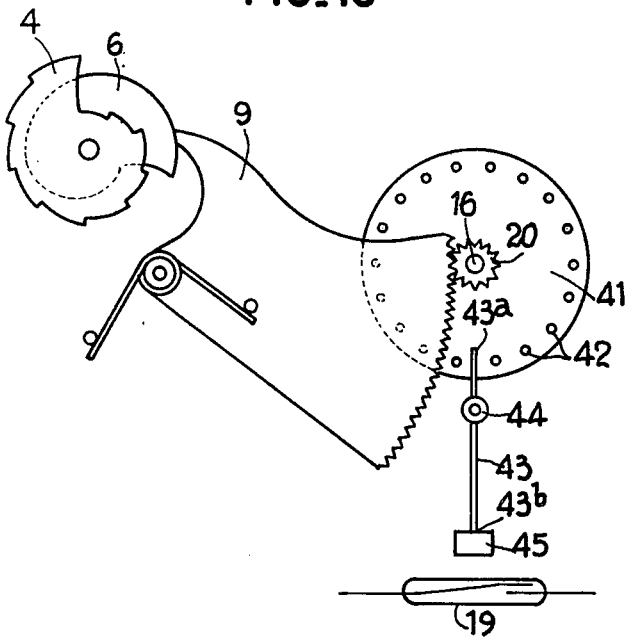
FIG. 10 is a partial diagrammatic view of another embodiment of the device according to the invention.
Figure 11:
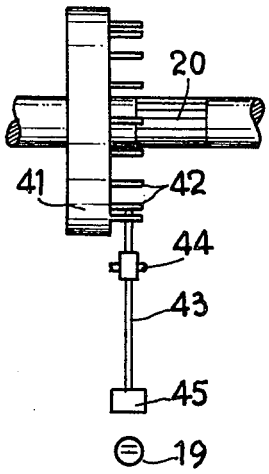
FIG. 11 is a partial end elevational view of the device shown in FIG. 10.

The modification shown in FIGS. 10 and 11 differs from the first embodiment in that the wheel 17 carrying the magnets is replaced by a wheel 41 having lateral pins 42. This wheel 41 is driven in rotation in the same way as the disc 17 through a gear pinion 20 which is connected to rotate therewith. A needle 43, pivotally mounted on a pin 44 parallel to the shaft 16 of the wheel, has one end portion $43^a$ extending between two pins 42 toward the centre of the wheel 41 and its other end porton $43^b$ carries a magnet 45 in front of which there is located the switch 19 having the flexible blades. The assembly is disposed in a vertical plane, as are also the follower 9, the drum and the cams 4 and 6, so that the weight of the magnet 45 gives to the needle 43 a vertical position of balance. The dimensions of the needle are such that when the wheel 41 rotates, the assembly 43-45 is shifted by the pins 42 to inclined positions so that the magnet 45 has no longer any effect on the switch 19. This is the case when the follower 9 bears against the stepped cam 4. It will therefore be understood that when the direction of rotation of the wheel 41 changes, in the beginning of the return movement of the follower 9, owing to the pivoting of the assembly 43-45, the state of the switch 19 also changes and this causes, as before, the start of the counting of the pulses.

Figure 12:
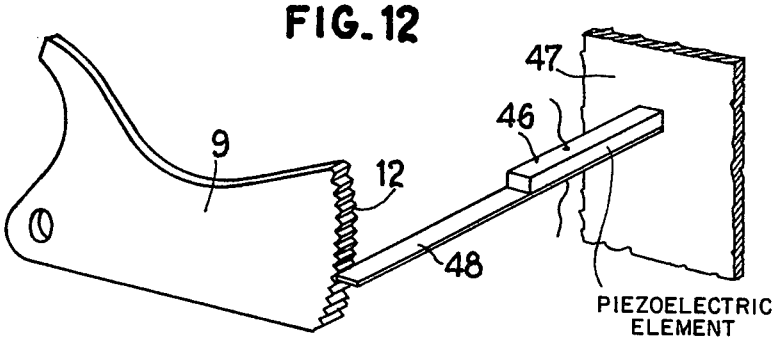
FIGS. 12 and 13 are partial diagrammatic views of other embodiments of the device according to the invention.

FIG. 12 shows another device for amplifying and detecting the movement of the follower 9. A piezoelectric bar 46 is embedded in a fixed surface 47 and extends in a plane perpendicular to the toothed sector 12 of the follower 9. The bar 46 is extended by a flexible blade or strip 48 which is located in its plane and has a free end bearing on the toothed sector 12. The teeth of the latter are cut in such manner that an elementary return movement of the follower 9 under the action of the smooth cam 6 causes the end of the flexible blade 48 to jump at least one tooth. When it undergoes a variation of flexion, the piezoelectric bar 46 has in the known manner a difference of potential between its surfaces and, when amplified, this difference of potential is employed in the same way as the change of state of the switch 19 of the foregoing embodiments for closing the counting circuit of the reading apparatus. The amplifying device, known per se, has not been shown.

Figure 13:
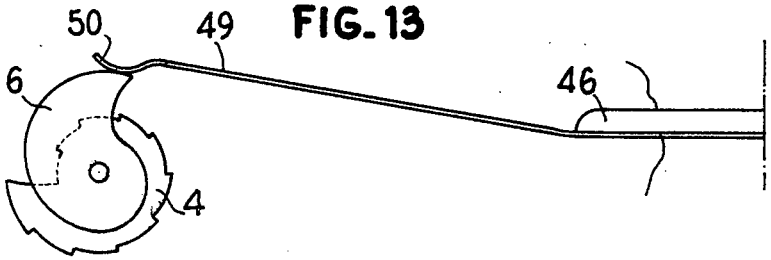

In the embodiment shown in FIG. 13, there is again employed as a detecting device a piezoelectric bar 46 but the latter is this time disposed longitudinally with respect to the plane of the cam 6 and it is extended by a flexible blade or strip 49 whose end has the shape of a nose 50 which bears directly on the peripheral surface of the smooth cam 6 or of the stepped cam 4. In this modification, it is therefore the amplifying blade 49 which performs directly the follower function, the follower 9, such as that shown in the other embodiments, being eliminated.

In the last two embodiments, the detector 26 is of course modified and gives the counting order upon the appearance of the first voltage following the instant $t^1$ produced by the bar 46.

Figure 14:
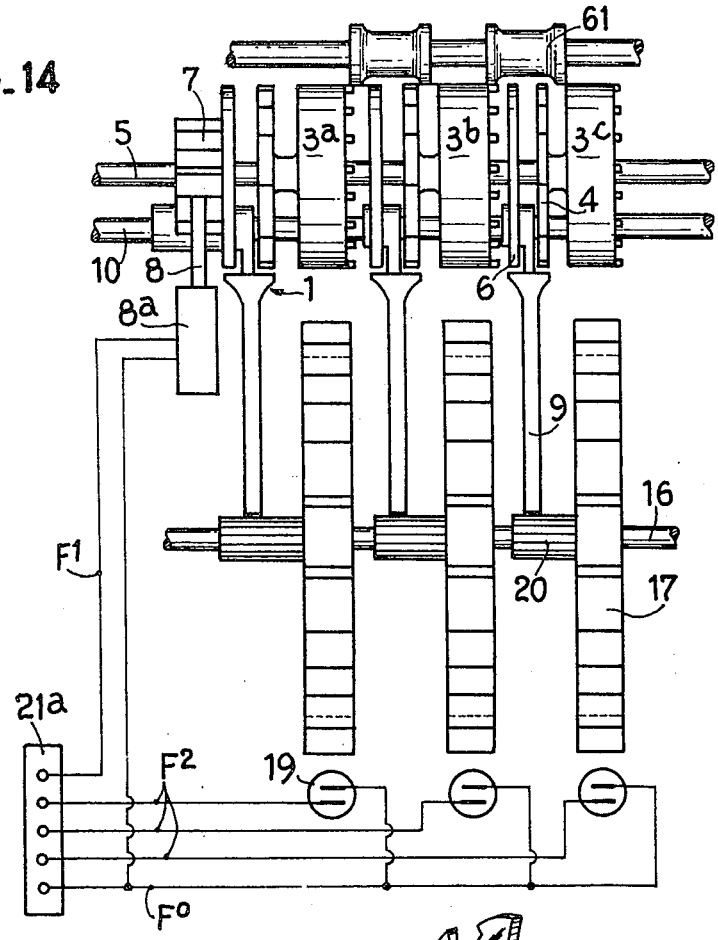
FIG. 14 is a partial plan view of a device according to the invention applied to the simultaneous reading of the indications of three drums.

FIG. 14 illustrates the application of the invention to the simultaneous reading of three indicator drums $3^a$, $3^b$, $3^c$ which are interconnected in the known manner by jumping gear pinions 61. This device may of course be applied to any number of coaxial drums. A device such as shown in FIG. 1 is associated with each one of the drums with the same relative arrangement in the coder units 1, but there is provided a single ratchet wheel 7 driving a shaft 5 which is common to the different smooth cams 6. There is a counting circuit for each drum and each one of the counting circuits, which are independent, is actuated by the return movement of the corresponding follower 9. As there is only one pulse-generating circuit for driving the ratchet wheel, the assembly requires five wires connected to the five terminals of an exterior socket $21^a$: a common reference voltage wire $F^0$, a wire $F^1$ for the electromagnet, and a wire $F^2$ for each switch 19 having flexible blades. The reading apparatus shown in FIG. 4 is consequently modified in a manner obvious to one skilled in the art and need not be described.

Figure 15:
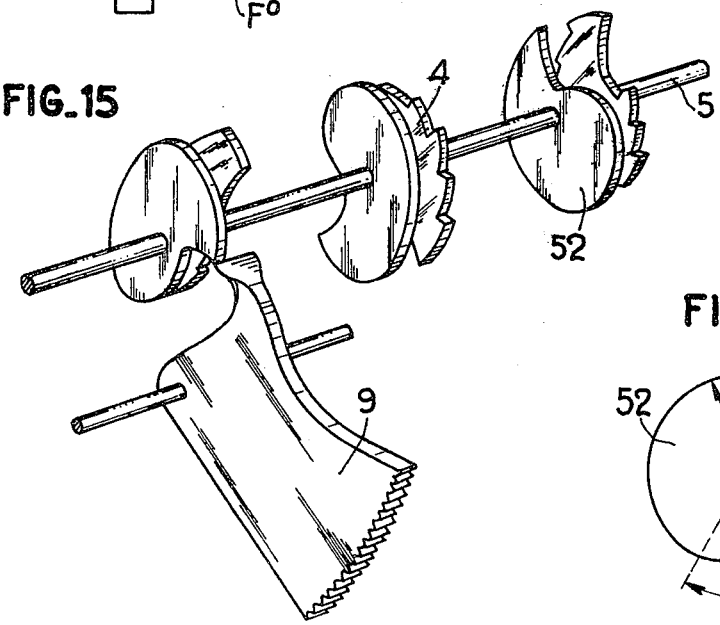
FIG. 15 is a partial perspective view of a device according to the invention applied to the sequential reading of the indications of three drums.

FIG. 15 shows the application of the invention to the sequential reading of three coaxial drums. The general arrangement is identical to that shown in FIG. 14 and only some of the elements thereof have been shown so as to render the drawing more clear.

Figure 16:
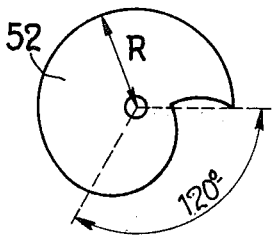
FIG. 16 is a detail view of a cam employed in the device shown in FIG. 15.

The difference between the two assemblies resides essentially in the smooth cams 52, which are of the type shown in FIG. 16. These smooth cams 52 have, extending over an angular extent of 240°, a constant radius R and, in the remaining 120°, the radius varies between the end radii of the sectors of the stepped cams 4. The three smooth cams 52 are mounted on the shaft 5 to be offset 120° from each other. In this arrangement, the ratchet wheel 7 (not shown) has thirty teeth. All the switches 19 are connected to the same pair of wires; an exterior socket having three terminals is therefore used.

The reading apparatus 22 is modified to operate in the following manner. The switch 29 of the programmer closes 30 times in the course of the reading, the switch 30 closes between the 1st and the 2nd pulse, opens after the 10th pulse, closes between the 11th and 12th pulse, opens after the 20th pulse, closes between the 21st and 22nd pulse and finally opens after the 30th pulse, indicating the end of the reading. The detector 26 therefore operates during three distinct periods, corresponding to the measurement of each one of the drums, and gives a zero-setting and count-initiating order three times to the counter, at the start of the return movement of each follower 9. By way of a modification, three counters may be provided with a successive connecting device or, with a single counter, a successive actuation of the display drums.

Thus, upon a complete revolution of the ratchet wheel 7, each of the followers 9 operates in succession. It will indeed be understood that, when one of the three followers 9 effects its return movement in cooperation with the part of variable radius of the associated smooth cam, the other two followers are in their position of rest bearing against a portion of a smooth cam having a constant radius and cause no change in the state of the associated switch 19. In this way there is a sequential reading of the indications of the three drums. At the end of thirty actuating or command pulses, the indications of the three drums are recorded and the whole of the device is ready for a new reading.

To extend this assembly to the sequential reading of n drums, there would be employed smooth cams which have a radius which varies only in 1/n revolution and are offset from each other 360/n° and the programmer would produce 10 n pulses.

In the devices shown in FIGS. 14 and 15, it will be understood that any amplifying means (gearing or flexible blade, for example) and any pulse-generating device (switch having flexible blades or piezoelectric bar, for example), may be employed.

Figure 17:
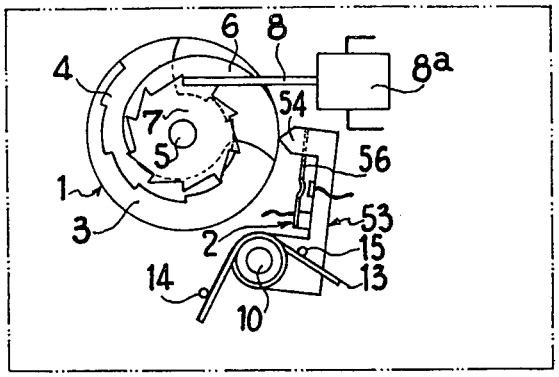
FIG. 17 is a partial diagrammatic side elevational view of a totalizer drum coupled to a device according to another embodiment of the invention.
Figure 18:
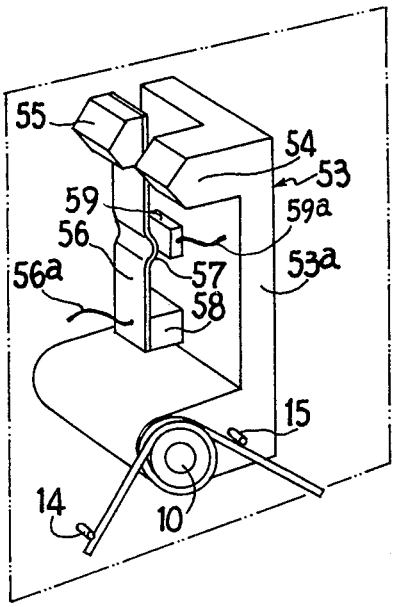
FIG. 18 is a diagrammatic perspective view of the follower of the device shown in FIG. 17.

The transmission device shown in FIGS. 17 and 18 comprises a number of essential elements of the device described hereinbefore with reference to FIG. 1 and these elements carry the same reference numerals. Thus this device comprises a coding unit 1 and a detecting device 2 and is adapted to read the indications of a drum 3 which is connected to rotate with a stepped cam 4 which is divided into ten sectors of increasing radii, the assembly comprising the drum 3 and the stepped cam 4 being driven in rotation by the mechanism of the meter (not shown). This assembly is freely rotatable on the shaft 5 on which there are secured a cam 6 and a ratchet wheel 7 which has ten teeth and is actuated by a ratchet 8 whose movement is controlled by a pulse-producing electromagnet $8^a$, one pulse causing the wheel 7 (and therefore the smooth cam 6 connected to rotate therewith) to advance 1/10 of a revolution in the direction of increasing radius of the smooth cam 6.

The coding unit 1 also comprises a follower 53 pivotally mounted on a pin 10 which is parallel to the shaft 5, the follower being constantly elastically biased against the cams 4 and 6 by a spring 13 which is coiled around the pin 10 and has one end disposed under a pin 14 provided on a fixed surface of the housing of the device and its other end bearing under a pin 15 carried by the follower 53.

The follower 53 comprises a C-shaped body 53$^a$ having one end portion pivotally mounted on the pin 10 and another end portion carrying a first nose 54 whose width is roughly equal to the axial extent of the smooth cam 6 and located in the plane of the latter. The follower 53 also has a second nose 55 located in the plane of the stepped cam 4 and having a width roughly equal to the axial extent of the latter. The nose 55 is carried by one end of a resilient metal electrically conductive strip 56 which is provided in its middle with a corrugation 57 which projects from the opposite side of the strip 56 to the stepped cam 4. The other end of the strip 56 is fixed to the body 53$^a$ of the follower 53 by a block of insulating material 58. The body 53$^a$ carries an electrical contact 59 in facing relation to the corrugation 57. The second nose 55, the strip 56 and the electrical contact 59 constitute the detecting device 2 and are arranged in such manner that, when the nose 55 does not bear on the stepped cam 4, there is no electrical contact between the strip 56 and the contact 59. Moreover, in this case, the noses 54 and 55 are in the same plane and disposed in side-by-side relation as shown in FIG. 18.

The switch 56-59 thus formed is electrically connected by wires 56$^a$ and 59$^a$ to a detector (not shown) which detects the change of state of this switch and is itself connected to the device counting the pulses furnished to the electromagnet 8$^a$.

Figure 4:
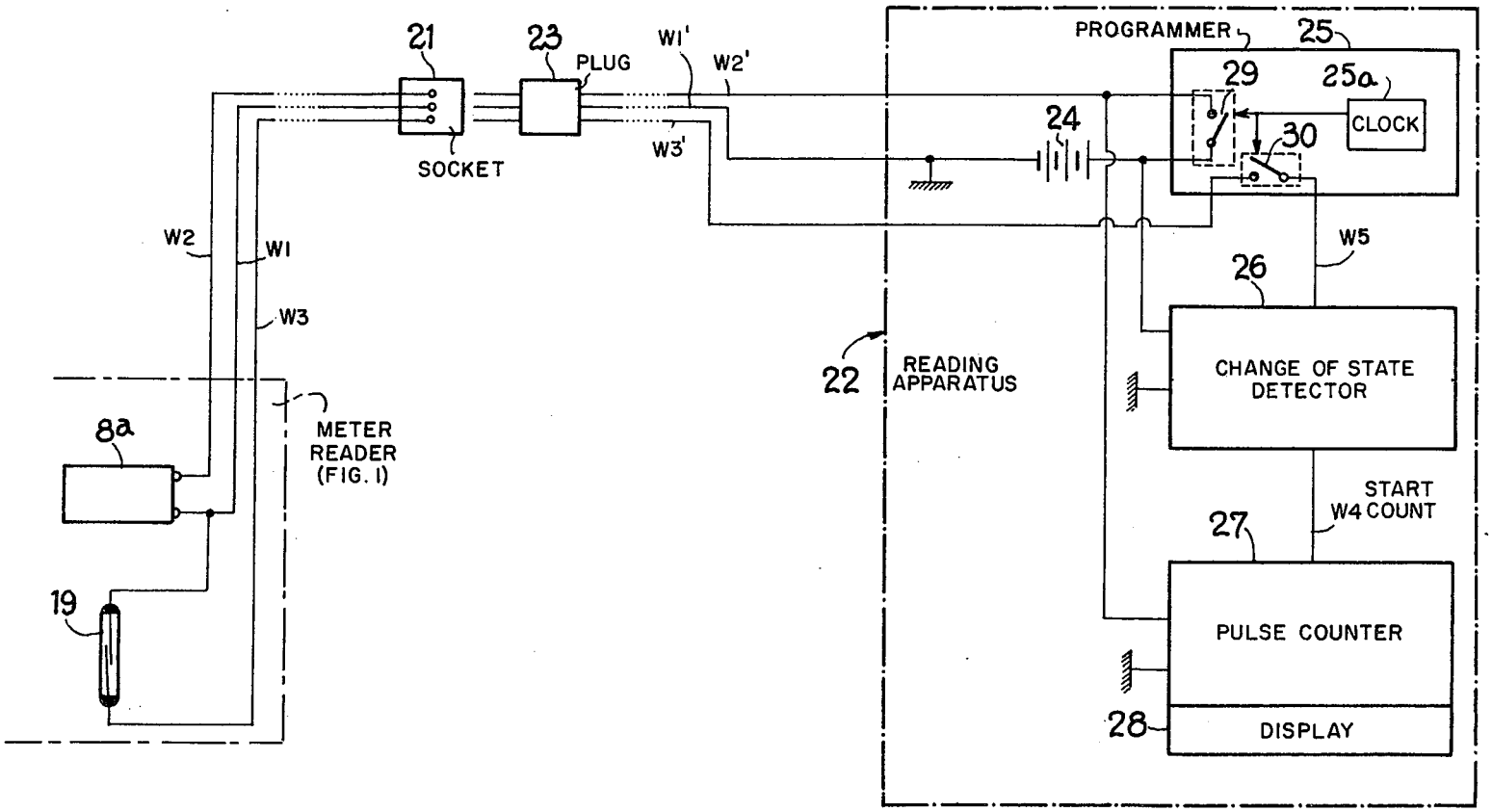
FIG. 4 is a diagrammatic view of the eletrical parts of the device and of its reading apparatus.

The rest of the transmission device is constituted by electrical and electronic means which are well known per se and have been described hereinbefore, together with their connections, with reference to FIG. 4. The essential difference between the two arrangements resides in the replacement of the switch 19 having flexible blades by the electrical switch 56-59; more precisely the follower 53 replaces the nose 9, the disc 17 and the switch 19 shown in FIG. 1.

As the operation of the whole of the device is similar to that of the device shown in FIG. 1, only the operation of the coding unit and detecting device of the transmission device shown in FIGS. 17 and 18 will be described.

It will be assumed that the smooth cam 6 is in a starting position so that its part having the largest radius faces the nose 54 of the follower 53 and the nose 55 does not bear against the stepped cam 4, the radius of the latter being less in this position than the radius of the smooth cam which corresponds to an indication of the drum 3 between FIGS. 1 and 9 inclusively. The electrical switch 56-59 is open in this position.

When the meter reading apparatus is plugged in, a series of ten pulses starts to be sent to the electromagnet 8$^a$ and this causes the ratchet wheel 7, and the smooth cam 6 associated therewith, to turn through a 10th of a revolution in the direction of increasing radii of the smooth cam 6.

Right from the start of the rotation of the cam 6, the nose 54 of the follower 53 is no longer supported by the cam 6 and, under the action of the spring 13, the follower 53 pivots until the second nose 55 comes in contact with the stepped cam 4. The elastically yieldable resistance of the strip 56 is less than the force exerted by the spring 13 so that the corrugation 57 of the strip 56 touches the electrical contact 59; the switch 57-59 is then closed — which precludes any counting of the pulses.

The electromagnet 8$^a$ continues to rotate the smooth cam through the ratchet wheel 8. The switch 57-59 remains closed until there is a coincidence of the angular positions between the two cams 4 and 6, that is to say when the radius of the smooth cam under the nose 54 becomes equal to the radius of the stepped cam under the nose 55.

When the following pulse occurs, the smooth cam 6 urges back the follower 53 by its nose 54 and the nose 55 is moved away from the stepped cam 54 under the effect of the resilience of the strip 56 and the switch 57-59 is opened. The opening of this switch initiates the start of the counting of the pulses required to cause the smooth cam to return to its initial position and consequently the number of sectors between the sector of the largest radius and the sector on which there was coincidence with the stepped cam. The reading of the indication of the drum 3 is thus achieved.

The coding device 1 and detecting device 2 according to the embodiment just described are very simple and therefore cheap and moreover of very small overall size, requiring only a double-nosed follower performing the function of an electrical switch.

Figure 19:
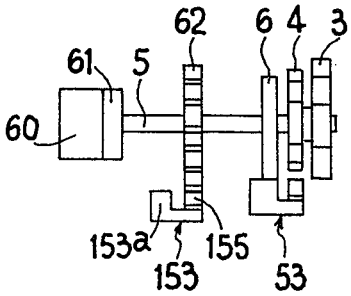
FIG. 19 is a partial diagrammatic plan view of another embodiment of the transmission device according to the invention.

According to another embodiment shown in FIG. 19, the electromagnet 8$^a$ and the programmer (not shown) furnishing a predetermined number of pulses controlling this electromagnet, are replaced by a motor 60 provided with a speed reducer 61 on its output shaft for driving in rotation the shaft 5 and a gear wheel 62 having ten teeth 63 fixed to the shaft 5. In the vicinity of the peripheral surface of the wheel 62, there is disposed a follower 153 of the same type as the follower 53 shown in FIG. 2. The body 153$^a$ of this follower is fixed and its nose 155, elastically connected to the body 153$^a$, is in contact with the peripheral surface of the wheel 62, the relative disposition of the latter and of the follower 153 being such that the electrical switch formed by the resilient strip supporting the nose 155 and the body 153$^a$ of the follower 153 closes only upon the passage of the teeth of the wheel. In this way, owing to the presence of electrical accessories known per se (not shown), the smooth cam 6 is driven in rotation by the motor-speed reducer 60-61 during the period of time corresponding to the counting of ten closures of the electrical switch of the follower 153, that is to say, in one complete revolution.

It will be observed in this last embodiment that the counting of the pulses is independent of the speed of rotation of the motor, since the counting pulses are only produced by the rotation of the wheel 62 and therefore of the shaft 5. Moreover, the fact that it is not an exterior programmer which initiates pulses at predetermined intervals of time but that the pulses are produced by the actual rotation of the smooth cam 6, renders the apparatus very reliable in operation. Indeed, if the shaft 5 does not rotate, no pulse can be received by the follower 153 and consequently cannot be counted and the operator very easily notices that the apparatus is defective in operation.

In the embodiment shown in FIG. 19, the follower-switch 153 described is identical to the follower 53 shown in FIG. 18, but it may be replaced by any contact or any means for detecting the rotation of the shaft 5 and furnishing pulses as a function of this rotation.

It will be understood that the embodiments shown in FIGS. 17 to 19 may be adapted to the reading of any number of drums in the same way as described with reference to FIGS. 14 to 16.

Having now described my invention what I claim as new and desire to secure by Letters Patent is:

1. In a device for transmitting over a distance the angular position of rotary elements such as indicator drums of a meter, comprising an exterior connector, a current generating and decoding reading apparatus for making a reading of the angular position of the rotary elements, the reading apparatus being detachably connected in the connector, an encoding unit comprising for each rotary element a stepped cam which has steps in successive equal sectors of the stepped cam and is connected to rotate with the corresponding rotary element, the steps being positioned on radii of the cam which increase progressively from a first of said steps to a last of said steps, a movable follower combined with the cam to be driven by the cam, elastically yieldable means for biasing the follower against the stepped cam, a smooth cam coaxial with the stepped cam, drive means for driving the smooth cam in rotation, the smooth cam having a camming surface cooperative with the follower and capable of maintaining the follower spaced away from the steps of the stepped cam outside periods in which the reading apparatus makes said reading, and a device for detecting movement of the follower; the improvement comprising the following features: the smooth cam has in at least a part of the smooth cam a camming surface which has a radius which increases progressively to shift the follower to the same extent as said radii of said steps between a minimum radius corresponding to the radius of said first step and a maximum radius corresponding to the radius of said last step, a substantially radially extending surface interconnecting the maximum radius part and the minimum radius part of the camming surface, said drive means being capable of causing the smooth cam to effect a predetermined number of rotational steps in the direction of increasing radii of said camming surface, the angular extent of said rotational steps corresponding to the angular extent of said steps of the stepped cam, means being provided in the reading apparatus for counting the steps effected by the smooth cam while the follower cooperates with said part of the smooth cam.

2. A device as claimed in claim 1, wherein the detecting device comprises first electrical means for producing a signal in response to any movement of the follower and the reading apparatus comprises a programmer for furnishing to the drive means a number of pulses which number of pulses corresponds to said predetermined number of rotational steps and for closing the circuit of said electrical means at an instant between the first two pulses, a pulse counter and second electrical means for sending a signal of the start of the counting to said pulse counter when it receives the first signal from the first electrical means.

3. A device as claimed in claim 1, wherein the detecting device further comprises means for amplifying the movement of the follower.

4. A device as claimed in claim 3, wherein the amplifying means comprises a wheel rotatable about an axis, a toothed sector provided on the follower, a gear pinion meshing with the toothed sector and connected to rotate with the wheel.

5. A device as claimed in claim 4, wherein the wheel carries on its periphery magnets having alternating poles, the first electrical means comprising a switch having flexible contact strips disposed in front of said wheel, the strips being capable of opening and closing under the effect of the alternating poles of the magnets.

6. A device as claimed in claim 4, wherein said wheel carries in the vicinity of its periphery lateral pins, and a needle pivotally mounted on a pin parallel to the axis of rotation of the wheel has one end portion cooperative with the lateral pins and an opposite end portion carrying a magnet, the first electrical means comprising a switch having flexible contact strips disposed under said magnet in a position of equilibrium of said magnet so as to be opened and closed under the effect of the position of said magnet.

7. A device as claimed in claim 1, wherein the drive means comprise a ratchet wheel and an associated ratchet which ratchet is actuated by a pulse-producing electromagnet.

8. A device as claimed in claim 1, wherein the smooth cam is disposed coaxially with the stepped cam, the follower having an end nose capable of bearing against that one of the cams which has in front of said nose its peripheral surface the most remote from the common axis of said two cams.

9. A device as claimed in claim 1, wherein for the purpose of reading simultaneously the angular position of a plurality of coaxial rotary elements, the transmission device further comprises a common drive means for driving the smooth cams, the reading apparatus comprising a pulse counting assembly for each rotary element.

10. A device as claimed in claim 1, wherein for the purpose of sequentially reading the angular position of n coaxial rotary elements, said part having a variable radius of each smooth cam extends angularly over 1/nth of the periphery, the remainder of the periphery having the maximum radius of said part and said smooth cams are mounted on a common shaft, each smooth cam being offset 1/nth of a revolution with respect to the preceding smooth cam.

11. A device as claimed in claim 1, wherein the drive means is a motor having an output shaft which is provided with means for detecting the rotation of the output shaft and producing pulses as a function of said rotation, said detecting means being adapted to stop the motor when the smooth cam has effected said predetermined number of steps.

12. A device as claimed in claim 11, wherein said detecting means comprise a toothed wheel secured to the shaft and a follower nose elastically biased toward the toothed wheel and cooperating with a fixed contact so as to produce pulses producing said rotational steps upon the passage of the teeth of the toothed wheel.

* * * * *